US006942464B2

(12) United States Patent
Brashears et al.

(10) Patent No.: US 6,942,464 B2
(45) Date of Patent: Sep. 13, 2005

(54) AIR COMPRESSOR WITH IMPROVED HAND PORTABILITY

(75) Inventors: Richard K. Brashears, Phoenix, MD (US); John E. Buck, Cockeysville, MD (US); Mark J. Downes, Belair, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/154,416

(22) Filed: May 23, 2002

(65) Prior Publication Data

US 2003/0180156 A1 Sep. 25, 2003

Related U.S. Application Data

(60) Provisional application No. 60/366,676, filed on Mar. 22, 2002.

(51) Int. Cl.[7] ..... F04B 53/00
(52) U.S. Cl. ..... 417/234
(58) Field of Search ..... 417/234

(56) References Cited

U.S. PATENT DOCUMENTS

| | | | |
|---|---|---|---|
| 1,186,157 | A | 6/1916 | Abell |
| 2,434,675 | A | 1/1948 | Simpson |
| D170,330 | S | 9/1953 | Miller |
| 2,812,895 | A | 11/1957 | Peeps |
| 4,077,747 | A | 3/1978 | Burenga |
| 4,662,551 | A | 5/1987 | Dudley et al. |
| D293,682 | S | 1/1988 | Liou |
| D328,465 | S | 8/1992 | Schwarz et al. |
| D352,292 | S | 11/1994 | Morgan |
| D352,293 | S | 11/1994 | Morgan |
| D377,799 | S | 2/1997 | Kruzel et al. |

(Continued)

FOREIGN PATENT DOCUMENTS

| | | |
|---|---|---|
| DE | M 97 02 295 | 9/1997 |
| FR | 1.140.265 | 1/1956 |
| FR | 1.140.265 | 2/1957 |
| FR | 1.263.641 | 5/1961 |

OTHER PUBLICATIONS

Printout illustrating commercially available air compressors marketed by Porter Cable (taken from www.portercable.com). Date unknown.

Printout illustrating air compressors available through PowerToolDepot.com (taken from www.powertooldepot.com). Date unknown.

Printout of Specifications for Campbell Hausfeld Model FP2000 Compressor (taken from www.chpower.com). Date unknown.

Printout of specifications from press release for Stanley Model CWC200ST (taken from www.stanleyworks.com). Date unknown.

Printout of Specifications for Bostitch Model CAP2045ST–OL 2 (taken from www.amazon.com). Date unknown.

Printout of Rolair models D 1500HPV5, OD1500HMSS4, D2000HSSV5 & DO75LS3 (taken from www.rolair.net). Date unknown.

*Primary Examiner*—Charles G. Freay
(74) *Attorney, Agent, or Firm*—Harness, Dickey & Pierce P.L.C.

(57) ABSTRACT

An air compressor package having improved stability and portability. The air compressor package is positionable in an operational position, wherein the air compressor package is positioned on a base, and a transport position, wherein the air compressor package is hand portable via a handle. Positioning of the air compressor package into the transport position is accomplished by pivoting the air compressor package about the base and positions the center of gravity of the air compressor in an orientation and position that is relatively comfortable.

37 Claims, 6 Drawing Sheets

U.S. PATENT DOCUMENTS

| | | | | |
|---|---|---|---|---|
| D384,676 | S | | 10/1997 | Cyphers et al. |
| D440,578 | S | | 4/2001 | Nolan |
| D444,796 | S | | 7/2001 | Morgan |
| D444,797 | S | | 7/2001 | Davis et al. |
| D444,798 | S | | 7/2001 | Morgan |
| D452,253 | S | | 12/2001 | Matthew et al. |
| 6,375,437 | B1 | | 4/2002 | Nolan |
| 6,406,270 | B1 | * | 6/2002 | Kopel ..... 417/237 |
| 6,468,048 | B1 | * | 10/2002 | Burkholder et al. ..... 417/234 |
| 6,551,066 | B2 | * | 4/2003 | Saylor et al. ..... 417/243 |
| 2002/0131872 | A1 | | 9/2002 | Lucchi |

* cited by examiner

AIR COMPRESSOR WITH IMPROVED HAND PORTABILITY

CROSS-REFERENCE TO RELATED APPLICATIONS

This application is a continuation-in-part of U.S. Appl. Ser. No. 29/136,877 filed Feb. 8, 2001, which issued as U.S. Design Pat. No. D461,196 on Aug. 6, 2002. This application also claims the benefit of U.S. Provisional Appl. No. 60/366,676, filed Mar. 22, 2002.

FIELD OF THE INVENTION

The present invention generally relates generally to the field of portable air compressors and more particularly to hand portable air compressors with improved portability and ruggedness.

BACKGROUND OF THE INVENTION

Small air compressors have become common tools around the home, workshop and work site. For home, recreation and other light duty uses such as inflating sports or recreation equipment or for emergency use in inflating a car tire a number of very small and lightweight compressors are available. Such tasks require relatively low-pressure compressed air and/or relatively low airflow rates. Weight is kept low and portability is maximized in these designs by use of small, low volume and/or low-pressure compressors powered by small lightweight electric motors. Additionally, significant weight, size and cost savings are achieved by the omission of a high-pressure vessel (i.e., air tank), as well as an oil lubrication system.

Many jobs, however, require higher air pressures, and/or greater instantaneous air flow demands which typically exceed the capacity of the hobby or recreational use compressors. To satisfy the demands of higher air pressure and higher airflow tasks it is necessary to increase the size of the compressor and the related motor or engine. Furthermore, rather than sizing the compressor to meet the maximum theoretical instantaneous air flow demand, it is common design practice to include a compressed air reservoir in the form of an air tank or other pressure vessel. The tank, usually with an output regulator, can hold a quantity of pressurized air to meet peak demands from serviced loads, while allowing the use of a smaller and lighter compressor that charges the tank and is capable of meeting the average compressed air flow rate for the intended use.

The air tank and the larger compressor that are typically required to meet the desired pressure and airflow levels substantially increase the weight and overall size of the compressor package. Units designed for high pressure and high volume tasks can rapidly reach a weight and size where the well-known motor vehicle mounted or towed trailer configuration is the only practical form. Still, there are a range of intermediate capacity air compressors that are common tools around the construction site and which are man portable.

Current models of man portable air compressor packages comprise a stand or supporting structure on or in which are mounted a motor or engine, an air compressor, an air tank, a discharge manifold and various valves, instrumentation and controls. Many of the larger portable configurations are provided with wheels, in what is often referred to as a wheelbarrow configuration, so that they can be moved by a single user. Examples of wheeled air compressors include Models D55170 and D55270, which are marketed by DeWalt.

Still, some users of intermediate capacity professional grade compressors find it necessary or desirable to have a compressor that is capable of being lifted and carried by hand. One common approach taken by air compressor manufacturers to improve the portability of such intermediate capacity professional grade compressors has been to redesign the air compressor so as to reduce its weight. Despite such efforts, intermediate capacity professional grade compressors frequently weigh more than 50 pounds and thus remain difficult to lift and move by hand, even for those users who are physically strong.

Aside from the issue of their weight, hand-portable intermediate capacity professional grade compressors are also known to be quite cumbersome to transport. In this regard, the configurations that use two cylindrical tanks or a single pancake tank (i.e., a cylindrical tank of large diameter but small height with convex ends) have become common, as have the mounting schemes for mounting the compressor and the motor. For example, configurations that use two cylindrical tanks typically mount the compressor and motor alongside the tanks, whereas configurations that use a single pancake tank typically mount the compressor and motor on an end of the tank.

These conventional air compressor arrangements provide a package with a relatively large base or footprint, and a center of gravity that is positioned in an approximately centered position within the footprint. While such arrangements provide the air compressor with a configuration that is relatively stable during its operation, lifting and carrying air compressors with these configurations tends to be rather awkward and difficult. In this regard, these configurations typically employ a handle (for lifting and carrying the air compressor) that is attached to an appropriate structure, such as the stand or the air tank, at a location that is located vertically above the center of gravity of the entire air compressor package. The handle is generally oriented in a manner that requires the air compressor package to be lifted vertically upwards and carried in an orientation that is substantially the same as the orientation in which it is operated.

Lifting and carrying the known intermediate air compressor packages in this manner, however, is relatively difficult, since the footprint of these air compressor packages tends to be relatively large and thus requires the user to hold the air compressor package with a somewhat outstretched arm such that the wrist of the user is in a state of flexion. In an effort to bring the air compressor package's center of gravity closer to the central axis of the user, the user will typically tilt their upper body away from the load of the air compressor package and thus will lift and transport the air compressor package with a body posture that is uncomfortable and awkward.

SUMMARY OF THE INVENTION

In one preferred form, the present invention provides an air compressor apparatus having a support structure, a compressor mechanism, an air tank and a handle. The support structure defines a base and is coupled to the compressor mechanism, the air tank and the handle. The air tank is in fluid connection with the compressor mechanism and has a capacity that is greater than about 0.5 gallons. The handle is configured to be grasped by the hand of a user so as to permit the air compressor apparatus to be rotated between an operating position, wherein the base lies in a first plane, and a transport position, wherein the base is skewed to the first plane.

In another preferred form, the present invention provides an air compressor package that is configured to be hand portable by a user. The air compressor package has a center of gravity ($CG_{ACP}$) and includes a support structure, an air tank, a compressor mechanism and a handle. The support structure defines a base and is coupled to the air tank, the compressor mechanism and the handle. The handle is configured to be grasped by a human hand such that a palmar surface of the hand is wrapped about a handle centerline. The air compressor package is positionable in an operative position, in which the base of the support structure is disposed in a substantially horizontal plane. The air compressor package is also positionable in a transport position, in which the base of the support structure is skewed to the substantially horizontal plane. The $CG_{ACP}$ and the handle centerline are contained in a generally vertically extending plane when the air compressor package is positioned in the transport position.

In another preferred form, the present invention provides an air compressor package that is hand portable by a person having a vertical axis. The air compressor package includes a support structure that defines a supporting surface and that is coupled to an air tank, an air compressor mechanism and a handle. The air compressor package is positionable on the supporting surface in an operating position. The operating position defines a substantially horizontal axis in which the air tank and the air compressor lie. The operating position also defines a top of the air compressor package and a bottom of the air compressor package which are approximately parallel to the supporting surface. The air tank and the air compressor lie in a substantially vertical second axis when the air compressor package is being carried by the person and a hand of the person is engaged to the handle. The second axis defines a second position in which one of the top and bottom of the air compressor package is positioned proximate a lateral side of the person carrying the air compressor package.

In still another preferred form, the present invention provides an air compressor package that is hand portable by a person having a vertical axis. The air compressor package includes a support structure that is coupled to an air tank, an air compressor and a handle. When the air compressor package is in operation and lying on a supporting surface that is defined by the support structure, then the center of gravity of the air tank ($CG_{AT}$) and the center of gravity the air compressor ($CG_{AC}$) lie along a substantially horizontal first axis that defines a first position, the substantially horizontal first axis being approximately parallel to the supporting surface. When the person is carrying the air compressor package by the handle, then the air tank and the air compressor lie along a substantially vertical second axis defining a second position, and the center of gravity of the air tank ($CG_{AT}$) and the center of gravity of the compressor ($CG_{AC}$) are substantially equidistant from the vertical axis of the person.

In yet another preferred form, the present invention provides an air compressor package that is hand portable by a user having an arm with a hand and a wrist. The air compressor package includes a support structure, which defines a base, an air tank, a compressor mechanism and a handle. The handle is coupled to one of the support structure, the air tank and the compressor mechanism and is configured to be engaged by a palmar surface of the user's hand such that the palmar surface is wrapped about a centerline of the handle. The air compressor package is positionable in a operational position, in which the base is disposed in a first plane, and a transport position, in which the base is disposed in a second plane that is skewed to the first plane. When the air compressor package is positioned in the transport position, the center of gravity of the air compressor package ($CG_{ACP}$) is vertically in-line with the centerline of the handle and the handle is positioned such that the wrist is both disposed proximate a lateral side of the user and not positioned in a state of flexion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENTS

Figure 1:
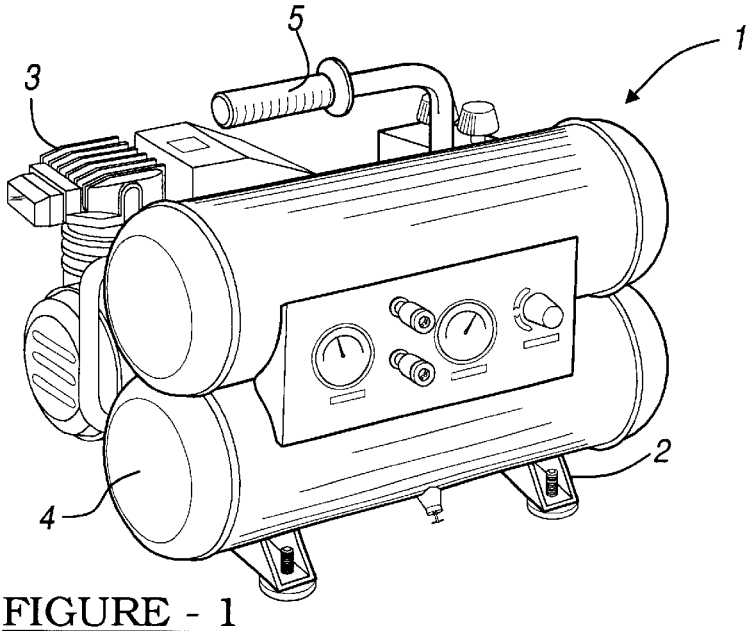
FIGURE - 1 (PRIOR ART)
FIG. 1 is a perspective view of a compressor package constructed in accordance with the teachings of the prior art.
Figure 2:
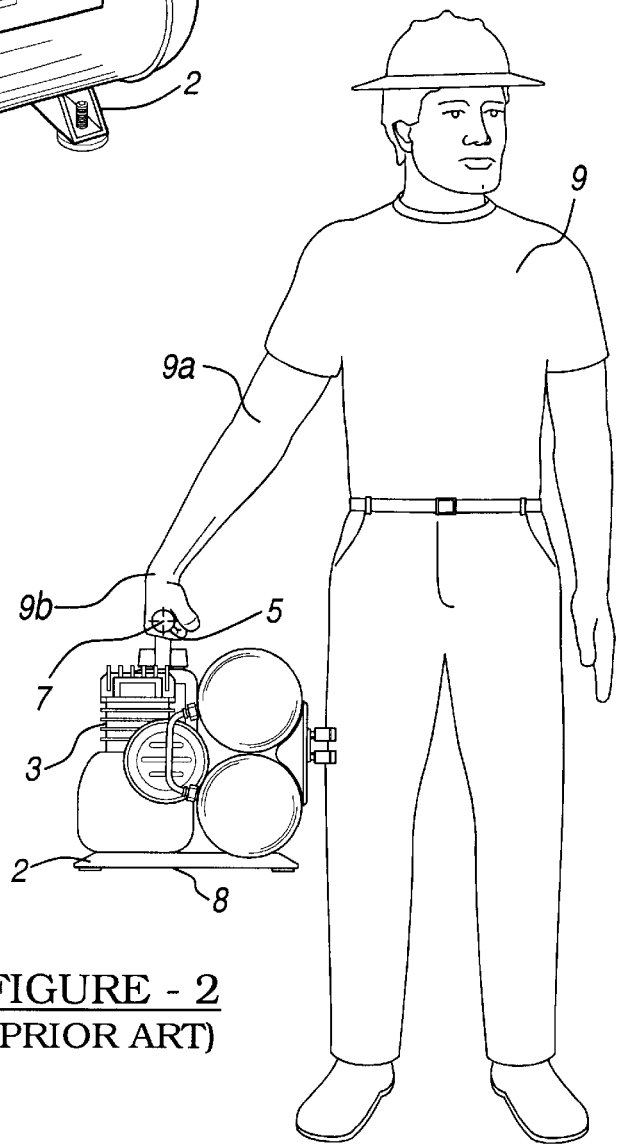
FIGURE - 2 (PRIOR ART)
FIG. 2 is a front view of a user transporting the compressor package of FIG. 1.

With reference to FIGS. 1 and 2 of the drawings, a prior art air compressor package 1 is illustrated to include a support structure 2, a compressor mechanism 3, an air tank 4 and a handle 5. The compressor mechanism 3 and the air tank 4, which are among the heavier components of the air compressor package 1, are distributed horizontally about the support structure 2 such that the center of gravity 6 of the air compressor package 1 is disposed well within the interior of an area bounded by the support structure 2. The handle 5 is coupled to the support structure 2 in a manner that places a centerline 7 of the handle 5 vertically in-line with the center of gravity 6 of the air compressor package 1.

With additional reference to FIG. 2, the configuration of the handle 5 is such that it permits the air compressor package 1 to be lifted vertically and transported in the same orientation as it is operated. The size of the footprint or base 8 of the air compressor package 1, however, is relatively large, which necessitates that the user 9 transport the air compressor package 1 with a somewhat outstretched arm 9*a*. Consequently, the user's wrist 9*b* is maintained in a state of flexion, which tends to be uncomfortable for the user and fatiguing.

Figure 3:
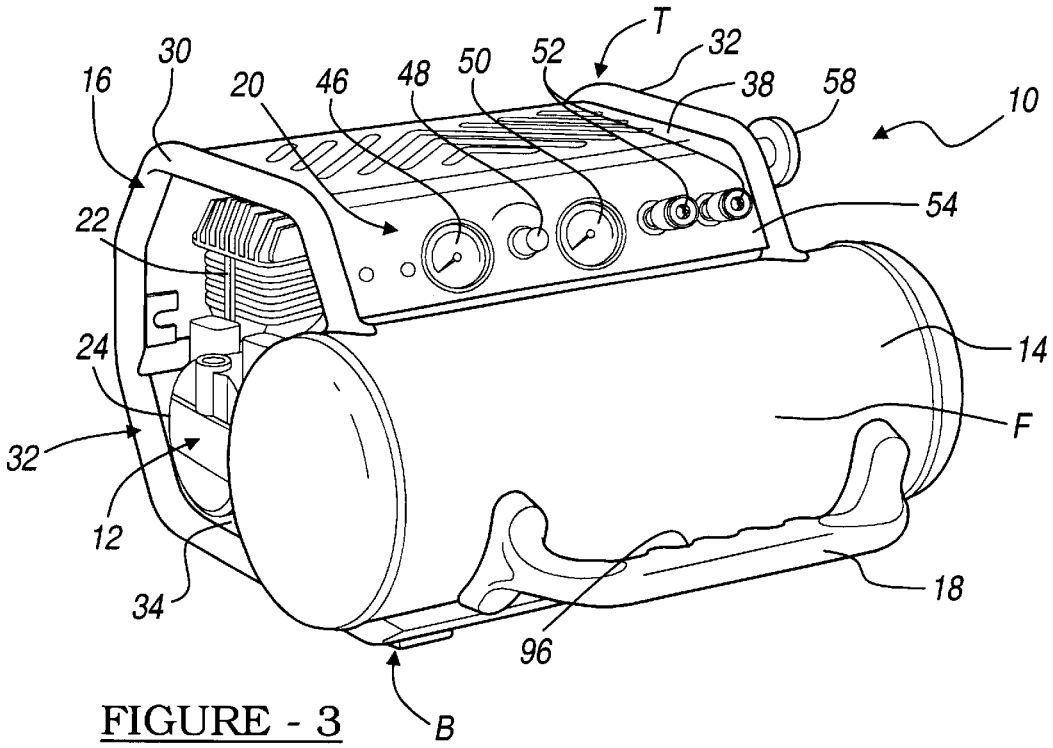
FIG. 3 is a perspective view of an air compressor package constructed in accordance with the teachings of the present invention.
Figure 4:
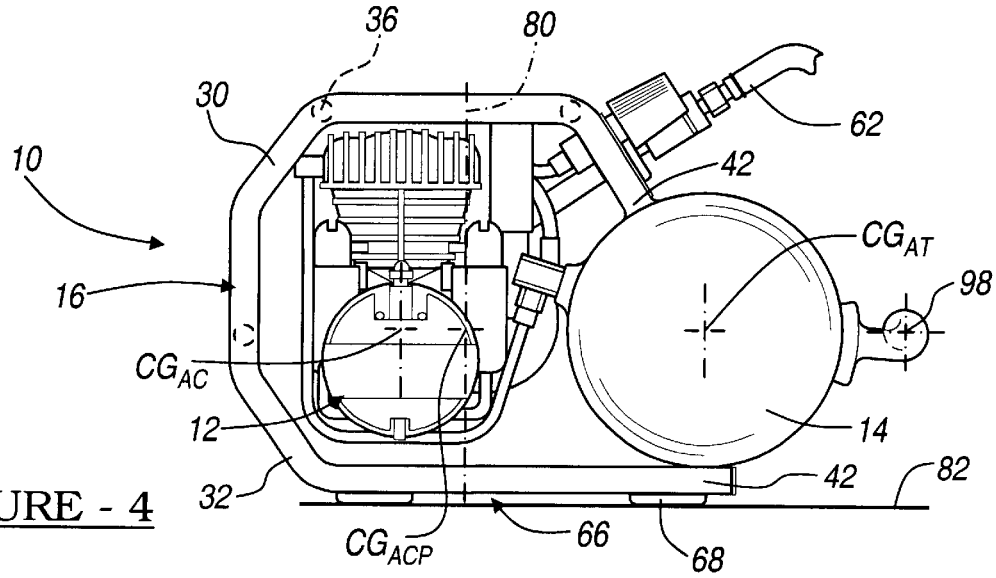
FIG. 4 is a left side elevational view of the air compressor package of FIG. 3 as positioned in an operational position.
Figure 5:
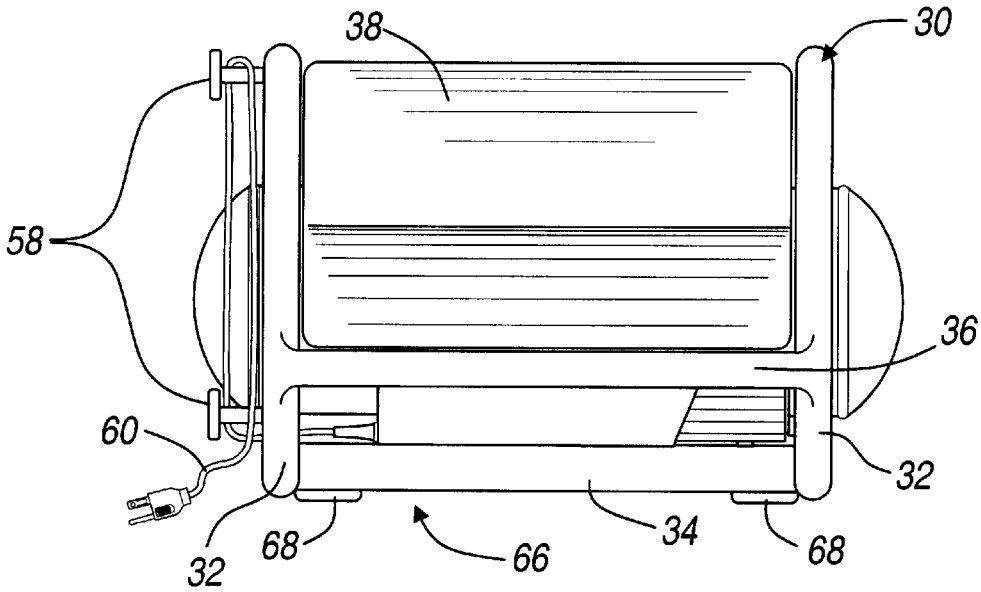
FIG. 5 is a rear elevational view of the air compressor package of FIG. 3.

In FIGS. 3 through 5, an air compressor package constructed in accordance with the teachings of the present invention is generally indicated by reference numeral 10. The air compressor package 10 is illustrated to include a compressor mechanism 12, an air tank 14, a support structure 16, a handle 18 and a gauge package 20. The compressor mechanism 12 is conventional in its construction and operation and as such, need not be discussed in detail herein. Briefly, the compressor mechanism 12 includes a compressor 22, which is operable for intaking and compressing ambient air, and a power source, such as an electric motor 24 or an engine, for providing power to the compressor 22. The compressed air that exits the compressor 22 is discharged to the air tank 14, which serves as a reservoir for the compressed air.

Figure 10:
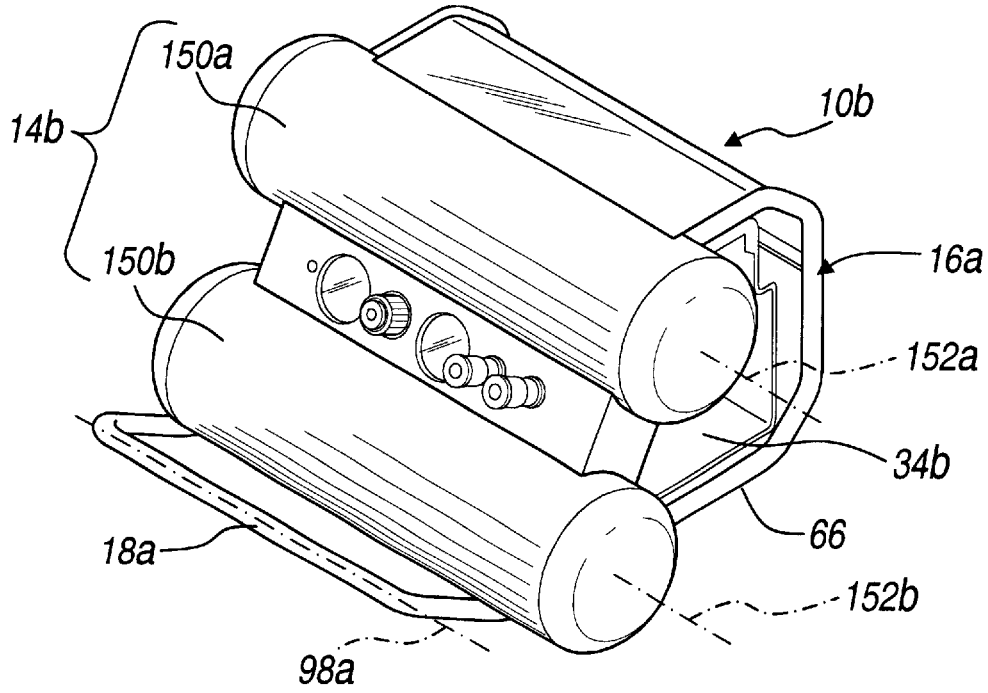
FIG. 10 is a perspective view of an air compressor package constructed in accordance with the teachings of another alternate embodiment of the present invention.

The air tank 14 has a capacity of at least 0.5 gallons and in the particular example provided, is illustrated as having a single cylindrically shaped tank structure. The air tank 14, however, preferably has a capacity of about 1 to about 8 gallons, and more preferably a capacity of about 3 to about 5 gallons. Those skilled in the art will understand that the air tank 14 may be configured somewhat differently, as with a conventional pancake-style (i.e., a relatively short and large diameter cylinder with convex ends) tank structure (not shown) or with a plurality of cylindrically shaped tank structures that are coupled in fluid connection as shown in FIG. 10.

The support structure 16 is illustrated to be configured in a "roll-cage" manner that extends around both the compressor mechanism 12 and the gauge package 20 to protect these components should the air compressor package 10 be overturned or impacted by another object. In the particular embodiment illustrated, the support structure 16 includes a tubular frame 30 having opposite laterally extending sides 32 that are interconnected by a mounting platform 34 and a plurality of strut members 36, as well as an optional shield or cover 38. In the example provided, the cover 38 is formed from a sheet material, such as steel, aluminum or plastic, and is removably fastened with, for example, conventional threaded fasteners (not shown) to the tubular frame 30. While the primary purpose of the cover 38 is to protect components such as the compressor mechanism 12 and the gauge package 20 from damaging contact with, for example, falling tools and workpieces, those skilled in the art will understand that the relatively smooth outer surface of the cover 38, when abutted against the lateral side of the user during transport, is relatively more comfortable and less likely to interfere with the movement of the user as compared to the tubular frame 30, the compressor mechanism, the air tank 14 and/or the gauge package 20.

In the example provided, the laterally extending sides 32 are constructed in an open manner, such that the ends 42 of the laterally extending sides 32 do not intersect one another but rather intersect the air tank 14. The ends 42 are coupled to the air tank 14 through a conventional coupling means, such as welds. In the particular embodiment illustrated, the air tank 14 extends through the laterally extending sides 32 but those skilled in the art will understand that the air tank 14 could alternatively be configured to terminate flush or inboard of the laterally extending sides 32 so that the support structure 16 would also protect the opposite ends of the air tank 14. The gauge package 20, which conventionally includes an air tank pressure gauge 46, a regulator 48, a regulator gauge 50 and an outlet manifold 52, is coupled to a gauge panel 54 that is mounted between the laterally extending sides 32 of the support structure 16. The gauge panel 54 may be a discrete component or may be integrally formed with the cover 38. Preferably, the gauge panel 54 is mounted in a rearwardly sloped orientation, which is best illustrated in FIGS. 3 and 4, as opposed to the substantially vertical orientation that is illustrated in the prior art air compressor package 1 of FIG. 1, so as to position the air tank pressure gauge 46, the regulator 48, the regulator gauge 50 and the outlet manifold 52 in a manner that is relatively more comfortable for the user of the air compressor package 10 to read and/or access. As those skilled in the art will appreciate, the improved readability of the air tank pressure gauge 46 and the regulator gauge 50 and the improved accessibility of the regulator 48 that result from the positioning of the gauge panel 54 in a rearwardly sloped orientation improves the accuracy with which the user is able to control the air pressure that is delivered to the outlet manifold 52. Pegs 58, which are coupled to one of the laterally extending sides 32 and extend outwardly therefrom, are optionally provided so as to permit items, such as a power cord 60 or an air hose 62, to be coiled (around the pegs 58) for storage.

The mounting platform 34, which is illustrated to be fabricated from a sheet material, such as steel, aluminum or plastic, serves as the base 66 of the support structure 16. The compressor mechanism 12 is coupled to the mounting platform 34 via a plurality of threaded fasteners (not specifically shown). A plurality of rubber feet 68 are affixed to the corners of the mounting platform 34 and serve to dampen vibrations that are transmitted through the support structure 16 as well as to provide the support structure 16 with a degree of skid resistance. With specific reference to FIG. 6, an access aperture 70 is formed through the mounting platform 34 and permits the user to access a valve mechanism 72 to manually drain the air tank 14.

With renewed reference to FIG. 4, those skilled in the art will appreciate that the air tank 14 and the compressor mechanism 12 are coupled to the support structure 16 such that their centers of gravity, $CG_{AT}$ and $CG_{AC}$, respectively, are positioned relatively close to the base 66 when the air compressor package 10 is oriented in its operational position (FIGS. 3 through 5). As the air tank 14 and the compressor mechanism 12 account for a majority of the weight of the air compressor package 10, configuration in this manner is advantageous in that it provides the air compressor package 10 with a relatively low center of gravity $CG_{ACP}$. As those skilled in the art will understand, the center of gravity $CG_{ACP}$ acts along a plane 80 that is skewed to the base 66. In the particular embodiment illustrated, the plane 80 is substantially perpendicular to the base 66 since the base 66 is situated on a flat surface 82, such as a floor.

Figure 7:
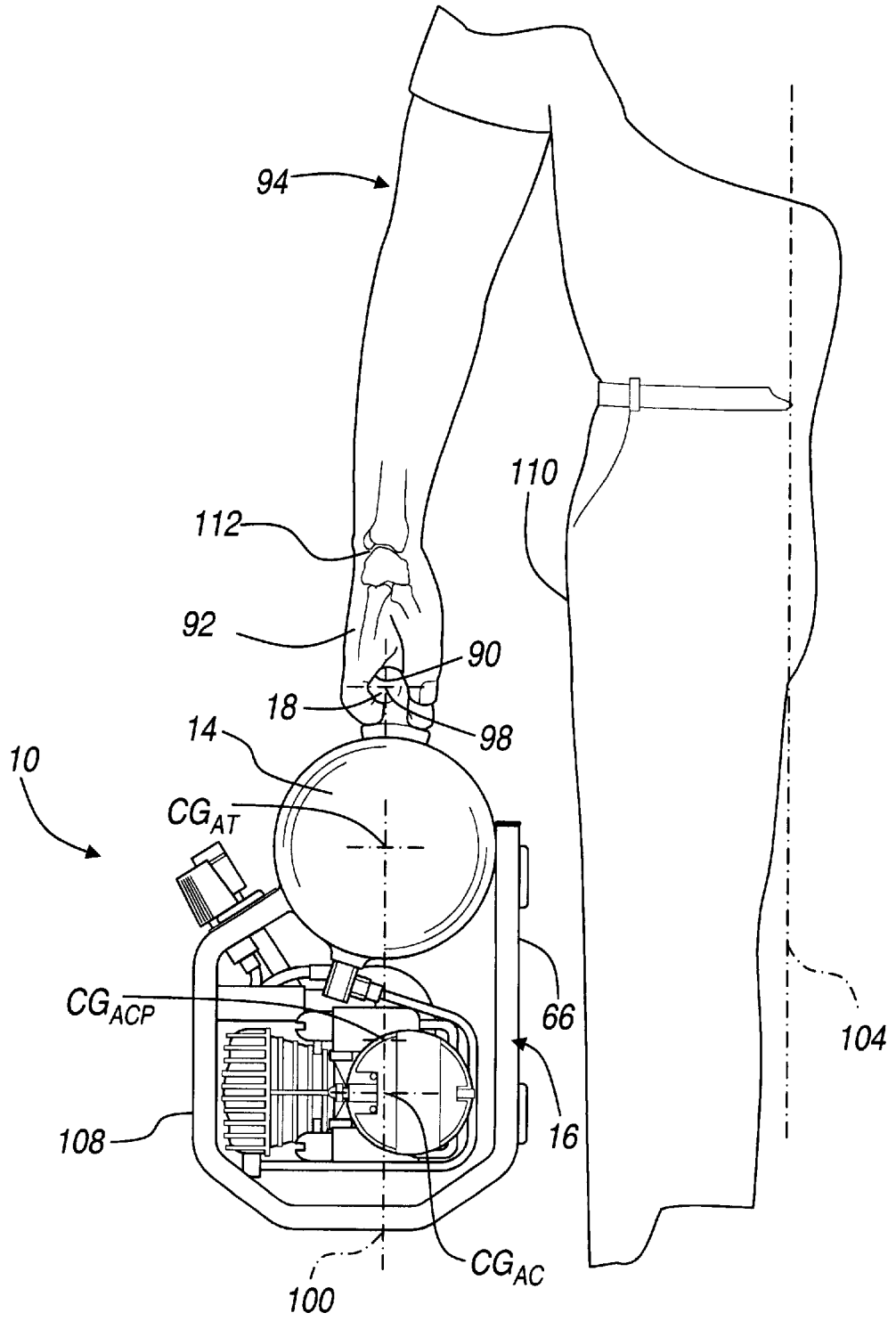
FIG. 7 is a left side elevational view of the air compressor package of FIG. 3 as positioned in a transport position.

With reference to FIGS. 3 and 7, the handle 18 is configured to be gripped by a palmar surface 90 of the hand 92 of a user 94 when the user 94 is transporting the air compressor package 10. The handle 18 may be of any type and may be mounted to any appropriate structure, such as the support structure 16 or the air tank 14. In the particular embodiment illustrated, the handle 18 is fixedly mounted to air tank 14 and includes a grip portion 96 that is contoured to receive the fingers of the user when the user is transporting the air compressor package 10. The grip portion 96 is formed about a centerline 98 that lies in (or is positionable into) a plane 100 that includes the center of gravity $CG_{ACP}$ of the air compressor package 10.

The handle 18 permits the user of the air compressor package 10 to reposition the air compressor package 10 from the operational position that is illustrated in FIG. 4 to a transport position that is illustrated in FIG. 7. When positioned in the transport position, the plane 100 that includes the centerline 98 of the handle 18 and the center of gravity $CG_{ACP}$ of the air compressor package 10 is located in a substantially vertical orientation that is generally parallel to a vertical (longitudinal) axis 104 of the user 94, as well as generally parallel to the base 66 and the top 108 of the air compressor package 10.

Furthermore, since the center of gravity $CG_{ACP}$ of the air compressor package 10 is relatively close to the base 66 when the air compressor package 10 is oriented in the operational position, the user 94 is able to transport the air compressor package 10 such that the base 66 is proximate a lateral side 110 of the user 94 (i.e., within about 10 inches of the lateral side 110, and preferably about 3 inches to about 7 inches) and the user's wrist 112 is not in a state of flexion. When placed in the transport position, the air compressor package 10 is preferably configured such that the centers of gravity $CG_{AT}$ and $CG_{AC}$ of the air tank 14 and the compressor mechanism 12 are disposed in the plane 100, or oppositely offset therefrom by substantially equal distances. With the handle 18 thus positioned, the user 94 is able to comfortably carry the air compressor package 10, as well as to easily pivot the air compressor package 10 between the operational position and the transport position without releasing the handle 18.

Figure 8:
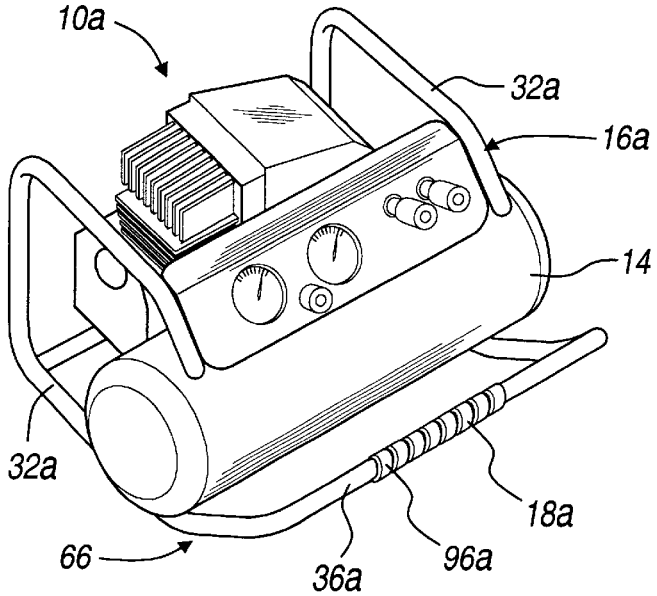
FIG. 8 is a perspective view of an air compressor package constructed in accordance with the teachings of an alternate embodiment of the present invention.
Figure 9:
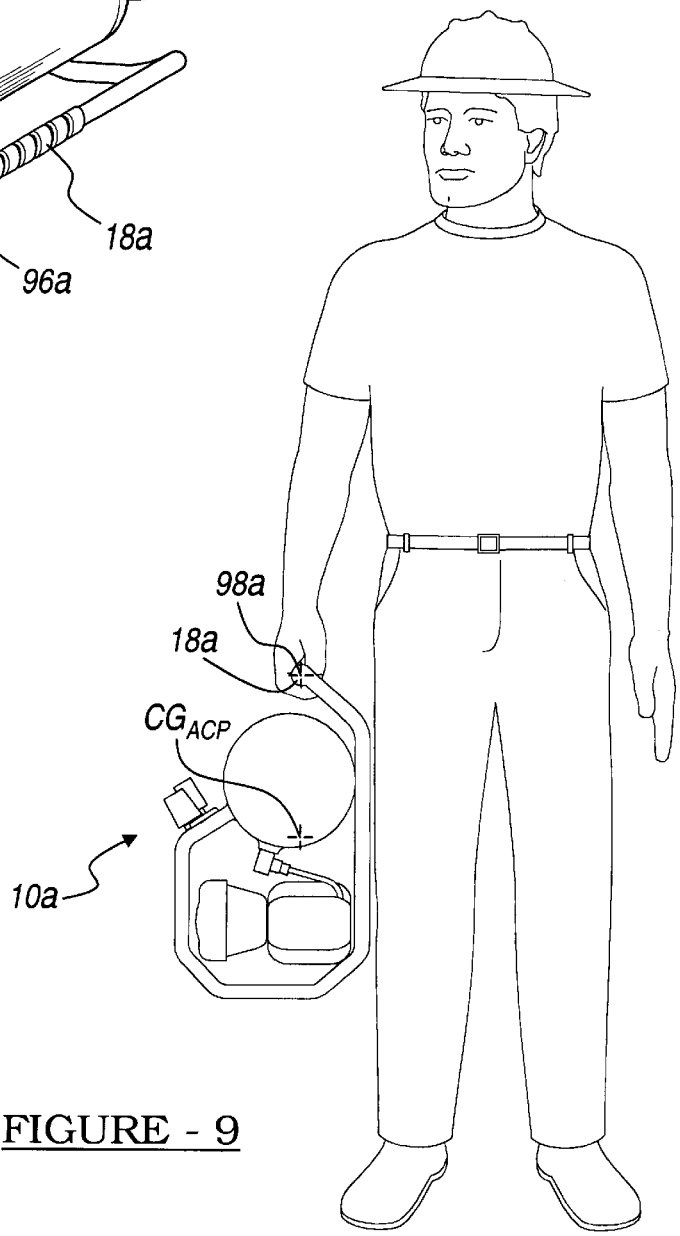
FIG. 9 is a left side elevational view of the air compressor package of FIG. 8 as positioned in a transport position.

While the air compressor package 10 has been described thus far as including an air tank 14 with a single cylindrically shaped tank structure and a handle 18 that is fixedly coupled to the air tank 14, those skilled in the art will appreciate that the invention, in its broader aspects, may be constructed somewhat differently. For example, the handle 18a may be incorporated into the support structure 16*a* as illustrated in FIGS. 8 and 9. In this embodiment, the support structure 16 extends around the air tank 14 on a side opposite the compressor mechanism 12 and upwardly from the base 66. A grip structure 96*a* is formed on the front strut member 36*a* that interconnects the opposite laterally extending sides 32*a*. Like the handle 18 of the air compressor package 10 that is illustrated in FIG. 3, the handle 18*a* is positioned such that a centerline 98*a* of the grip structure 96*a* is positioned in a plane that contains the center of gravity $CG_{ACP}$ of the air compressor package 10*a* when the air compressor package 10*a* is positioned in the transport position.

In the arrangement of FIG. 10, the handle 18*a* is similar to that of the embodiment of FIG. 8 in that it is incorporated with the support structure 16*a*. The air tank 14*b*, however, includes first and second generally cylindrical tank structures 150*a* and 150*b* which are stacked vertically relative to one another when the air compressor package 10*b* is placed in the operating position. In the arrangement illustrated, the first and second generally cylindrical tank structures 150*a* and 150*b* are disposed equidistantly on opposite sides of the plane (not specifically shown) that includes the centerline 98*a* of the handle 18*a* and the center of gravity $CG_{ACP}$. The longitudinal axes 152*a* and 152*b* of first and second generally cylindrical tank structures 150*a* and 150*b*, respectively, are illustrated to contained in a plane that is skewed to the base 66 to thereby minimize the amount by which the first and second generally cylindrical tank structures 150*a* and 150*b* are offset from the plane that includes the centerline 98*a* of the handle 18*a* and the center of gravity $CG_{ACP}$. In this arrangement, the mounting platform 34*b* may be elevated slightly relative to the mounting platform 34 of the air compressor package 10 so as to more easily and compactly package the air tank 14*b* and the compressor mechanism 12 so that the centerline 98*a* of the handle 18*a* is positioned in the manner described above.

Figure 6:
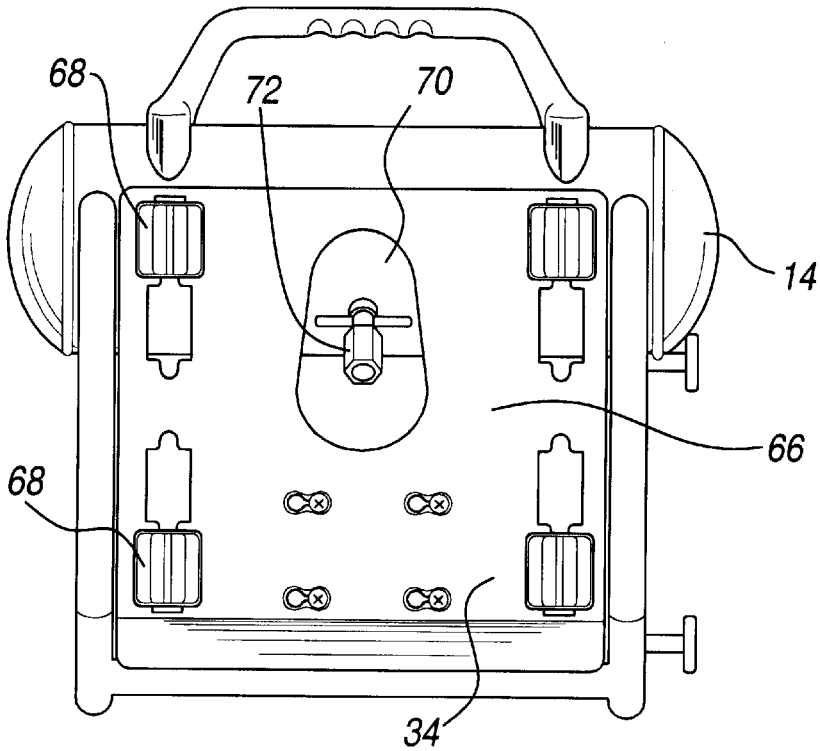
FIG. 6 is a bottom plan view of the air compressor package of FIG. 3.
Figure 11:
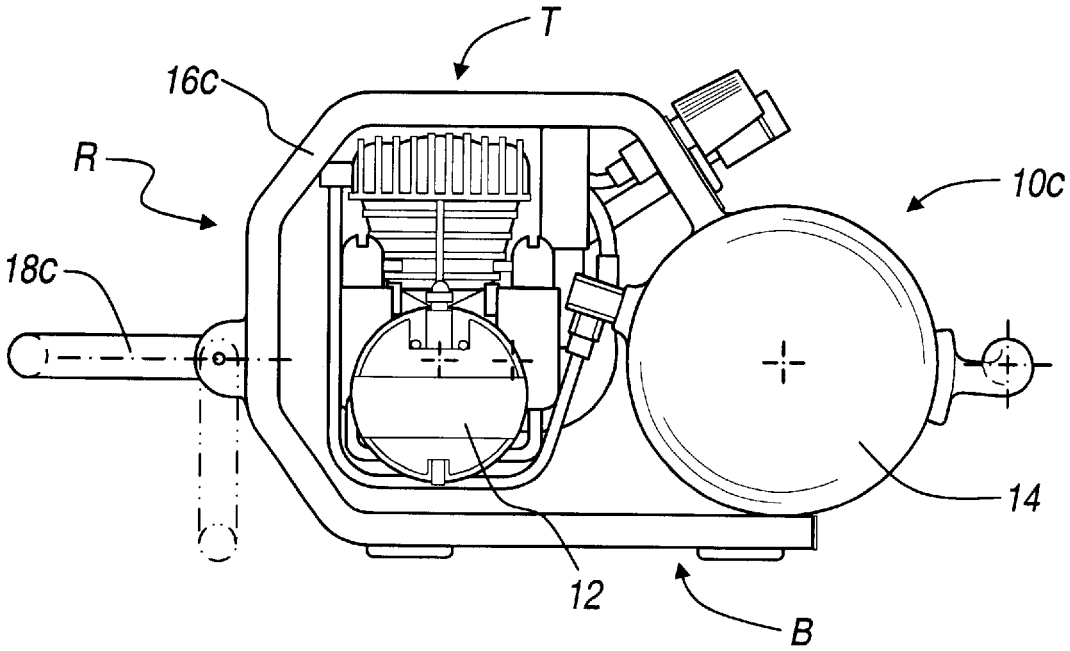
FIG. 11 is a left side elevational view of an air compressor package constructed in accordance with the teachings of still another alternate embodiment of the present invention.

The arrangement of FIG. 11 is generally similar to that of FIG. 3, except that the handle 18*c* is pivotably coupled to the support structure 16*c* on a side opposite the air tank 14. When positioned into the transport position, the compressor mechanism 12 is situated above the air tank 14. This arrangement also illustrates that the air compressor package of the present invention may be rotated about a generally horizontal axis between the operational and transport positions in any direction. For example, the embodiment of FIGS. 6 and 7 illustrate that the air compressor package 10 may be rotated from the front F of the air compressor package 10 to the bottom B (or top T) of the air compressor package 10, whereas the embodiment of FIG. 11 illustrates that the air compressor package 10*c* may be rotated from the rear R of the air compressor package 10*c* to the bottom B (or top T) of the air compressor package 10*c*. Those skilled in the art will understand that the air compressor package may alternatively be configured to rotated from a side of the air compressor package to the bottom (or top) of the air compressor package via handle 18*c*.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. An air compressor apparatus comprising:

a support structure defining a base;

a compressor mechanism coupled to the support structure;

at least one air tank in fluid connection with the compressor mechanism and coupled to the support structure, the at least one air tank having a capacity that is greater than about 0.5 gallons; and a handle coupled to at least one of the support structure and the at least one air tank, the handle being configured to be grasped by a hand of a user of the air compressor apparatus so that the air compressor apparatus can be rotated about a substantially horizontal axis between an operating position, wherein the base is disposed in a first plane, and a hand carried transport position, wherein the base is substantially skewed to the first plane.

2. The air compressor apparatus of claim 1, wherein a center of the handle is positioned in a vertical plane when the air compressor apparatus is positioned in the transport position, the vertical plane extending substantially through a center of gravity ($CG_{ACP}$) of the air compressor apparatus.

3. The air compressor apparatus of claim 2, wherein the handle is positioned such that when the air compressor apparatus is positioned in the transport position and the handle is grasped by the hand of the user such that the user is transporting the air compressor apparatus, a wrist of the user is not positioned in a state of flexion and the handle is disposed proximate a lateral side of the user.

4. The air compressor apparatus of claim 3, wherein the handle is positioned within about 10 inches of the lateral side of the user when the air compressor apparatus is positioned in the transport position, the handle is grasped by the hand of the user and the air compressor package is being transported by the user.

5. The air compressor apparatus of claim 4, wherein the handle is positioned within about 3 inches to about 7 inches of the lateral side of the user when the air compressor apparatus is positioned in the transport position, the handle grasped by the hand of the user and the air compressor package is being transported by the user.

6. The air compressor apparatus of claim 1, wherein the support structure is a cage that extends around at least a portion of the compressor mechanism.

7. The air compressor apparatus of claim 6, wherein the support structure includes a strut member that is disposed between a pair of laterally extending sides, the handle being coupled to the strut member.

8. The air compressor apparatus of claim 6, wherein the cage includes a pair of laterally extending sides, each of the laterally extending sides being formed in an open manner with end sections that do not intersect any other portion of the support structure and wherein the at least one air tank is coupled to the laterally extending sides such that each of the end sections is fixed to the at least one air tank so that the at least one air tank substantially closes the laterally extending sides of the cage.

9. The air compressor apparatus of claim 1, wherein the capacity of the at least one air tank is about 1 gallon to about 8 gallons.

10. The air compressor apparatus of claim 9, wherein the capacity of the at least one air tank is about 3 gallons to about 5 gallons.

11. The air compressor apparatus of claim 1, wherein the handle is pivotably coupled to the at least one of the support structure and the at least one air tank.

12. The air compressor apparatus of claim 1, wherein the at least one tank comprises a first cylindrically shaped structure that is mounted to the support structure such that a longitudinal axis of the first cylindrically shaped structure is generally parallel to the base of the support structure.

13. The air compressor apparatus of claim 12, wherein the at least one tank further comprises a second cylindrically shaped structure that is mounted to the support structure, the second cylindrically shaped structure having a longitudinal axis that is generally parallel the base.

14. The air compressor apparatus of claim 13, wherein the longitudinal axes of the first and second cylindrically shaped structures are spaced vertically apart from one another when the air compressor apparatus is positioned in the operating position.

15. The air compressor apparatus of claim 1, wherein the at least one air tank is entirely disposed within a volume defined by the support structure.

16. The air compressor apparatus of claim 1, wherein the support structure includes a cover member that shrouds at least a portion of the compressor mechanism.

17. The air compressor apparatus of claim 1, wherein a gauge package and an outlet manifold are coupled to at least one of the air compressor, the at least one air tank and the support structure, the gauge package including a first pressure gauge for measuring a pressure of a fluid contained in the at least one air tank, a regulator that is coupled in fluid connection with the at least one air tank, and a second pressure gauge for measuring a pressure of a fluid exiting the regulator.

18. The air compressor apparatus of claim 17, wherein gauge package further comprises a gauge panel to which at least one of the first and second pressure gauges are mounted, the gauge panel being coupled to the support structure such that it is oriented in a rearwardly sloped manner.

19. The air compressor apparatus of claim 1, wherein rotation of the air compressor apparatus from the operating position to the transport position entails rotation of the air compressor apparatus from one of the front and rear ends of the air compressor apparatus to one of the bottom and top ends of the air compressor apparatus.

20. An air compressor package that is configured to be hand portable by a user, the air compressor package having a center of gravity ($CG_{ACP}$), the air compressor package comprising:

a support structure defining a base;

an air tank coupled to the support structure;

a compressor mechanism coupled to the support structure and in fluid connection with the air tank; and a handle coupled to one of the support structure and the air tank, the handle being configured to be grasped by a human hand such that a palmar surface of the hand is wrapped about a generally horizontally disposed handle centerline;

wherein the air compressor package is positionable in an operative position in which the base of the support structure is disposed in a first position, and wherein the air compressor package is positionable in a transport position in which the base of the support structure is rotated about an axis parallel to the handle centerline.

21. The air compressor package of claim 20, wherein the $CG_{ACP}$ and the handle centerline are contained in a generally vertically extending plane when the air compressor package is positioned in the transport position.

22. The air compressor package of claim 20, wherein the air tank includes a first generally cylindrically shaped tank structure.

23. The air compressor package of claim 22, wherein the air tank includes a second generally cylindrically shaped tank structure that is in fluid connection with the first generally cylindrically shaped tank structure.

24. An air compressor package hand portable by a person having a vertical axis, the air compressor package comprising:

a support structure;

an air tank connected to the support structure;

an air compressor mechanism connected to the support structure; and a handle connected to the support structure;

wherein the air compressor package is positionable on a supporting surface in an operating position, the operating position defining a substantially horizontal axis about which the air tank and the air compressor lie, the operating position also defining a top of the air compressor package and a bottom of the air compressor package, the top and the bottom of the air compressor package being approximately parallel to the supporting surface; and wherein the air tank and the air compressor lie in about substantially vertical second axis when the air compressor package is being carried by a person and a hand of the person is engaged to the handle, the second axis defining a second position in which one of the top and bottom of the air compressor package is positioned proximate a lateral side of the person carrying the air compressor package.

25. An air compressor package hand portable by a person having a vertical axis, the air compressor package comprising:

a support structure;

an air tank connected to the support structure and having a center of gravity;

an air compressor connected to the support structure and having a center of gravity; and a handle connected to the support structure;

wherein when the air compressor package is in operation and lying on a supporting surface, then the center of gravity of the air tank and the center of gravity the air compressor lie along a substantially horizontal first axis that defines a first position, the substantially horizontal first axis being approximately parallel to the supporting surface; and wherein when the person is carrying the air compressor package by the handle, then the air tank and the air compressor lie along a substantially vertical second axis defining a second position, and the center of gravity of the air tank and the center of gravity of the compressor are substantially equidistant from the vertical axis of the person.

26. An air compressor package that is hand portable by a user, the user having an arm with a hand and a wrist, the air compressor comprising:

a support structure defining a base;

an air tank coupled to the support structure;

a compressor mechanism coupled to one of the air tank and the support structure, the compressor mechanism coupled in fluid connection to the air tank; and a handle coupled to one of the support structure, the air tank and the compressor mechanism, the handle being configured to be engaged by a palmar surface of the hand such that the palmar surface is wrapped about a centerline of the handle;

wherein the air compressor package is positionable in a operational position in which the base is disposed in a first plane; and wherein the air compressor package is positionable in a transport position in which the base is disposed in a second plane that is skewed to the first plane;

wherein when the air compressor package is positioned in the transport position, a center of gravity of the air compressor package is substantially vertically in-line with the centerline of the handle and the handle is positioned such that the wrist is both disposed proximate a lateral side of the user and not positioned in a state of flexion.

27. The air compressor apparatus of claim 2, wherein the user includes an arm and a wrist, the wrist interconnecting the hand to the arm, and wherein the handle is positioned such that when the air compressor apparatus is positioned in the transport position and hand carried such that the hand is grasping the handle and the are is disposed in a vertical attitude, the wrist of the user is not in a state of flexion.

28. The air compressor apparatus of claim 27, wherein the air compressor apparatus is configured such that the handle is positioned within about 10 inches of a lateral side of the user when the air compressor apparatus is positioned in the transport position and hand carried such that the hand is grasping the handle, the arm is oriented generally vertically and the wrist is not in flexion.

29. The air compressor apparatus of claim 28, wherein the air compressor apparatus is configured such that the handle is positioned within about 3 inches to about 7 inches of the lateral side of the user when the air compressor apparatus is positioned in the transport position and hand carried such that the hand is grasping the handle, the arm is oriented generally vertically and the wrist is not in flexion.

30. An air compressor apparatus comprising:

a support structure defining a base;

a compressor mechanism coupled to the support structure;

a substantially cylindrical air tank coupled to the support structure and in fluid connection with the compressor mechanism; and a handle coupled to the support structure, the handle being configured to be grasped by a hand of a user of the air compressor apparatus so that the air compressor apparatus can be rotated about a substantially horizontal axis between an operating position, wherein the base is disposed in a first plane, and a hand carried transport position, wherein the base is skewed to the first plane.

31. The air compressor apparatus of claim 30, wherein the support structure is a cage that extends around at least a portion of the compressor mechanism.

32. The air compressor apparatus of claim 31, wherein the support structure includes a strut member that is disposed between a pair of laterally extending sides, the handle being coupled to the strut member.

33. The air compressor apparatus of claim 31, wherein the cage includes a pair of laterally extending sides, each of the laterally extending sides being formed in an open manner with end sections that do not intersect any other portion of the support structure and wherein the at least one air tank is coupled to the laterally extending sides such that each of the end sections is fixed to the at least one air tank so that the at least one air tank substantially closes the laterally extending sides of the cage.

34. The air compressor apparatus of claim 30, wherein a longitudinal axis of the air tank is generally parallel to the base.

35. The air compressor apparatus of claim 30, wherein the support structure includes a cover member that shrouds at least a portion of the compressor mechanism.

36. The air compressor apparatus of claim 30, wherein a gauge package and an outlet manifold are coupled to at least one of the air compressor, tha at least one air tank and the support structure the gauge package including a first pressure gauge for measuring a pressure of a fluid contained in the at least one air tank, a regulator that is coupled in fluid connection with the at least one air tank, and a second pressure gauge for measuring a pressure of a fluid exitting the regulator.

37. The air compressor apparatus of claim 36, wherein gauge package further comprises a gauge panel to which at least one of the first and second pressure gauges are mounted, the gauge panel being coupled to the support structure such that it is oriented in a rearwardly sloped manner.

* * * * *

UNITED STATES PATENT AND TRADEMARK OFFICE

CERTIFICATE OF CORRECTION

PATENT NO. : 6,942,464 B2 
APPLICATION NO. : 10/154416
DATED : September 13, 2005
INVENTOR(S) : Richard K. Brashears et al.

It is certified that error appears in the above-identified patent and that said Letters Patent is hereby corrected as shown below:

Title Page,
Item Related U.S. Application Data, insert -- (63) Continuation-in-part of application No. 29/136,877 filed Feb. 8, 2001, now Pat. No. D461,196. --

Column 10,
Line 62, delete "in"; and after "about" insert -- a --.

Column 11,
Line 59, "are" should be -- arm --.

Column 12,
Line 49, "tha" should be -- the --.
Line 54, "exitting" should be -- exiting --.

Signed and Sealed this

Seventeenth Day of April, 2007

JON W. DUDAS
*Director of the United States Patent and Trademark Office*